US006209993B1

(12) United States Patent
Wang et al.

(10) Patent No.: US 6,209,993 B1
(45) Date of Patent: Apr. 3, 2001

(54) STRUCTURE AND FABRICATING METHOD FOR INK-JET PRINTHEAD CHIP

(75) Inventors: Chieh-Wen Wang, Hsinchu; Yi-Yung Wu, Taichung Hsien; Hung-Lieh Hu; Ming-Ling Lee, both of Hsinchu, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/282,023

(22) Filed: Mar. 29, 1999

(30) Foreign Application Priority Data

May 29, 1998 (TW) ..... 87108391

(51) Int. Cl.[7] ..... B41J 2/05
(52) U.S. Cl. ..... 347/65
(58) Field of Search ..... 347/62, 63, 65, 347/67; 216/27

(56) References Cited

U.S. PATENT DOCUMENTS

| | | | | |
|---|---|---|---|---|
| 4,922,265 | * | 5/1990 | Pan | 347/47 |
| 5,387,314 | * | 2/1995 | Baughman et al. | 347/65 |
| 5,572,244 | * | 11/1996 | Drake et al. | 347/63 |
| 5,658,471 | * | 8/1997 | Murthy et al. | 347/65 |
| 5,697,144 | * | 12/1997 | Mitani et al. | 347/65 |
| 5,877,791 | * | 3/1999 | Lee et al. | 347/63 |

* cited by examiner

*Primary Examiner*—John Barlow
*Assistant Examiner*—Juanita Stephens
(74) *Attorney, Agent, or Firm*—J. C. Patents; Jiawei Huang

(57) ABSTRACT

A method for fabricating a printhead chip. A silicon substrate having a first surface and a second surface is provided. A plurality of grooves is formed in the first surface by an etching process. A plurality of ink slots are formed in each of the grooves. Overflow grooves are formed in the first surface beside the grooves. A plurality of firing chambers is formed on the second surface. Each of the firing chambers is respectively connected to each of the ink slots.

21 Claims, 2 Drawing Sheets

STRUCTURE AND FABRICATING METHOD FOR INK-JET PRINTHEAD CHIP

CROSS-REFERENCE TO RELATED APPLICATION

This application claims the priority benefit of Taiwan application serial no. 87108391, filed May 29, 1999, the full disclosure of which is incorporated herein by reference.

BACKGROUND OF THE INVENTION

1. Field of the Invention

The present invention relates to an ink-jet printer. More particularly, the present invention relates to a method for fabricating an ink-jet printhead chip.

2. Description of the Related Art

In a conventional printhead chip, ink slots are formed on a silicon substrate. Since the silicon substrate is thick, the ink slots are long. As a result, a measurable resistance is generated when inks flow through the ink slots. The frequency response of the printhead chip is limited by the resistance. Furthermore, the ink slots may be clogged by overflow paste when the printhead chip adheres to an ink cartridge.

SUMMARY OF THE INVENTION

Accordingly, the present invention provides a method for fabricating an ink-jet printhead chip that reduces a resistance when inks flow through ink slots and prevents the ink slots from clogging.

To achieve these and other advantages and in accordance with the purpose of the invention, as embodied and broadly described herein, the invention provides a method for fabricating an ink-jet printhead chip. The method includes the following steps. A silicon substrate having a first surface and a second surface is provided. A plurality of grooves is formed in the first surface by an etching process. A plurality of ink slots is formed in each of the grooves. Overflow grooves are formed in the first surface beside the grooves. A plurality of firing chambers is formed on the second surface. Each of the firing chambers is respectively connected to each of the ink slots.

In the invention, the ink slots are formed in the groove, thus the length of the ink slot is short. The resistance generated when inks flow through the ink slot is reduced. During the adhesion process, the overflow groove stores redundant paste so that the ink slots are not clogged.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
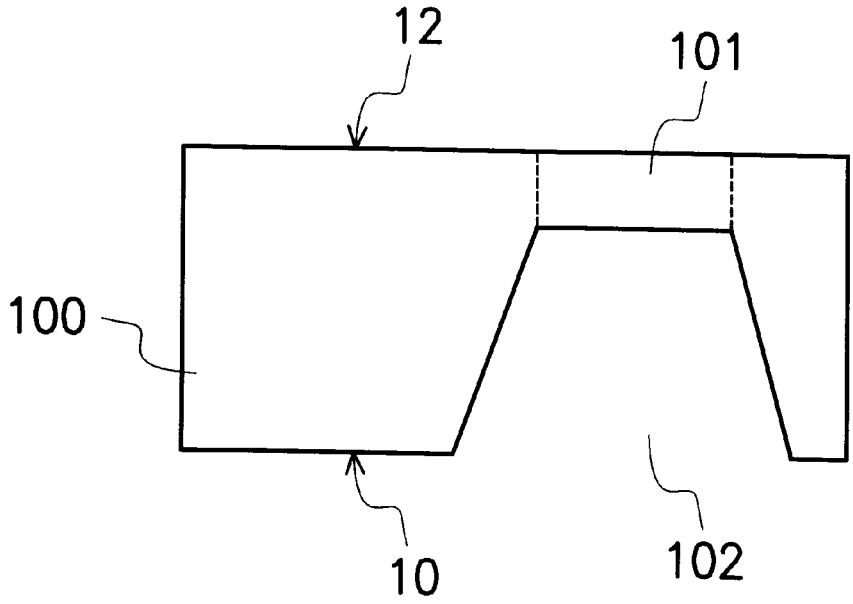
FIGS. 1A through 1C are schematic, cross-sectional diagrams used to depict steps in a method according to the invention for manufacturing an ink-jet printhead chip.

Reference will now be made in detail to the present preferred embodiments of the invention, examples of which are illustrated in the accompanying drawings. Wherever possible, the same reference numbers are used in the drawings and the description to refer to the same or like parts.

Figure 1B:
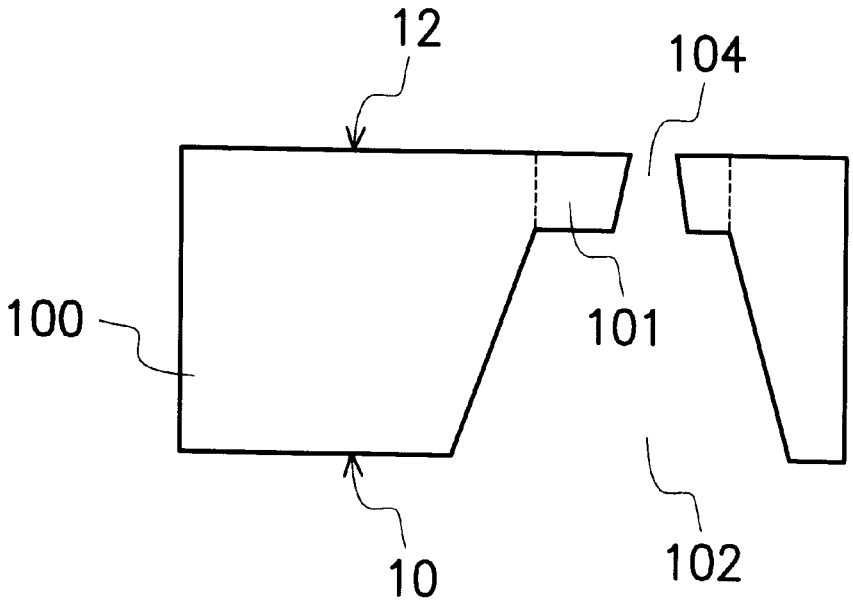
Figure 1C:
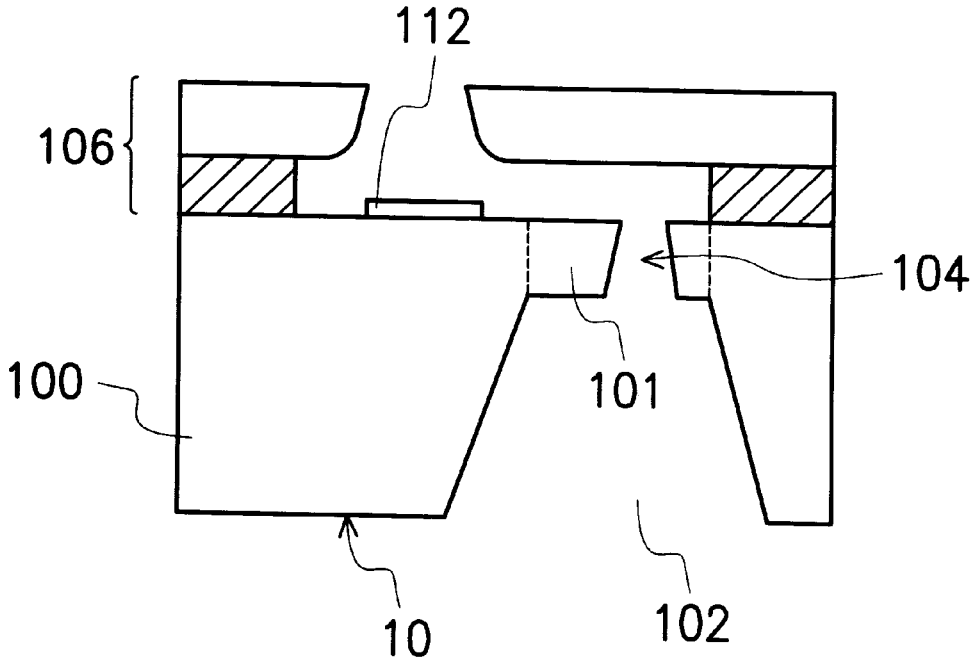

FIGS. 1A through 1C are schematic, cross-sectional diagrams used to depict steps in a method according to the invention for manufacturing an ink-jet printhead chip.

Referring to FIG. 1A, a silicon substrate 100 having a first surface 10 and a second surface 12 is provided. An etching process is performed on the first substrate 10, so that a groove 102 is formed. A region 101 for forming an ink slot is defined in the groove 102. The thickness of the region 101 is about 50 to 200 $\mu$m. The preferably thickness of the region 101 is about 70 $\mu$m. Since the thickness of the region 101 is thinner than the original thickness of the silicon substrate 100, a length of a subsequently formed ink slot in the region 101 is short.

Referring to FIG. 1B, an ink slot 104 is formed in the region 101. The step of forming the ink slot 104 includes anisotropic etching, isotropic etching, cutting with a laser or sandblasting.

Referring to FIG. 1C, a firing chamber 106 is formed on the second surface 12. The firing chamber 106 is connected to the ink slot 104. During a printing process, the firing chamber 106 is filled with ink through the ink slot 104.

Figure 2:
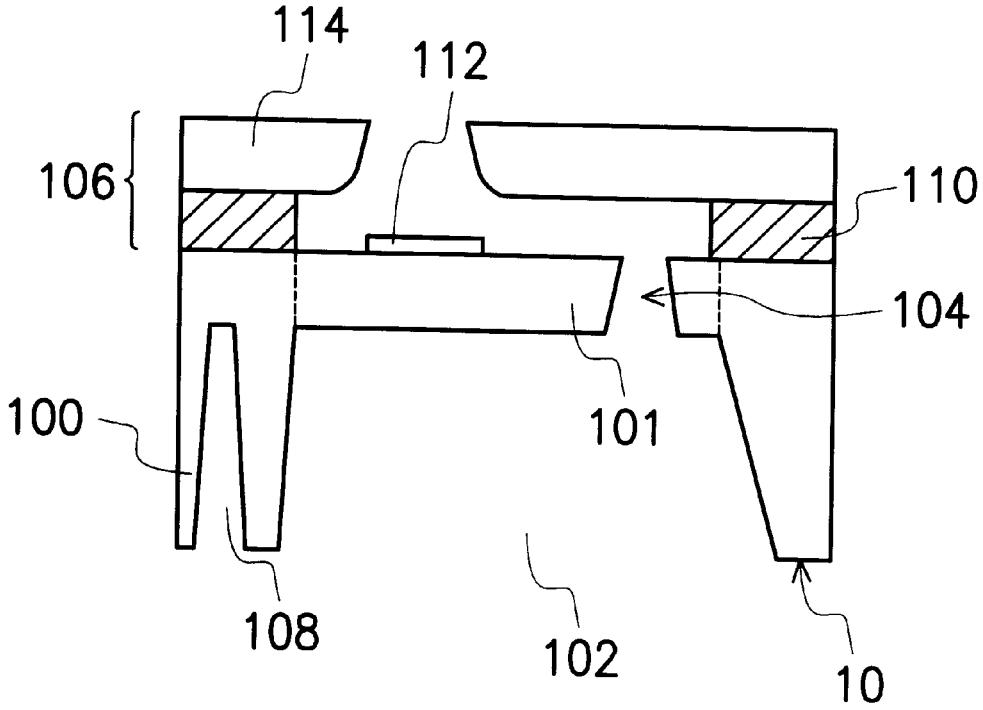
FIG. 2 is a schematic, cross-sectional diagram of an ink-jet printhead chip formed by the invention.

FIG. 2 is a schematic, cross-sectional diagram of an ink-jet printhead chip formed by the invention.

Referring to FIG. 2, an overflow groove 108 is formed on the first surface 10. The first surface 10 is for adhering to an ink cartridge. During the adhesion process, redundant paste flows into the overflow groove 108. Therefore, no paste flows into the groove 102 so that the ink slot 104 is not clogged.

As shown in FIG. 2, the firing chamber 106 is enclosed by walls 110 and includes a heater 112. A nozzle plate 114 is positioned over the firing chamber 106. The firing chamber 106 mentioned above is an example used for description in the invention. Any kind of firing chamber is suitable for the invention.

In a printing process, ink flows into the groove 102 from the ink cartridge, and then the firing chamber 106 is filled with the inks through the ink slot 104. The ink is vaporized by the heater 112 to form ink droplets. The ink droplets are expelled through the nozzle plate 114 to perform the printing process.

In the conventional printhead chip, the ink slots are directly formed on the silicon substrate. Because the silicon substrate is thick, a large surface of the silicon substrate is necessary to form the ink slots. In the invention, the same number of ink slots is formed in a smaller surface of the silicon substrate because the region for forming the ink slots is thinner. As a result, firing chambers of per unit area is increased, and a resolution of the printhead chip is also increased.

The ink slots are formed in the thin silicon substrate. The length of the ink slots is short, so that the resistance generated when inks flow through the ink slots is reduced.

In the invention, an overflow groove is formed on the surface for adhering to the ink cartridge. When the printhead chip adheres to the ink cartridge, redundant paste flows into the overflow groove so that the ink slots are not clogged. Yield of the printhead is increased.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for fabricating an ink-jet printhead chip, comprising the steps of:

providing a silicon substrate having a first surface and a second surface;

etching the first surface to form at least one groove in the silicon substrate, wherein the groove does not extend to the second surface;

after the groove being formed in the substrate, forming a plurality of ink slots in the silicon substrate, wherein the ink slots extend to the second surface of the substrate and connect the groove and the second surface, wherein a depth of the ink slots is equal to or larger than 50 $\mu$m, but less than 200 $\mu$m; and forming a plurality of firing chambers on the second surface, wherein each of the firing chambers is respectively connected to each of the ink slots.

2. The method of claim 1, wherein the ink slots are manufactured by either anisotropic or isotropic etching.

3. The method of claim 1, wherein the ink slots are manufactured by a laser.

4. The method of claim 1, wherein the ink slots are manufactured by sandblasting.

5. The method of claim 1, wherein the ink slots are connected to each other.

6. The method of claim 1, wherein each of the ink slots is individual.

7. A method for fabricating an ink-jet printhead chip comprising the steps of:

providing a silicon substrate having a first surface and a second surface;

etching the first surface to form a plurality of grooves in the silicon substrate;

after the grooves being formed in the substrate, forming a plurality of ink slots in the silicon substrate, wherein more than one said ink slots are formed in each of the grooves, and the ink slots connect the grooves and the second surface;

forming a plurality of overflow grooves on the first surface; and forming a plurality of firing chambers on the second surface, wherein each of the firing chambers is respectively connected to each of the ink slots.

8. The method of claim 7, wherein a depth of the ink slot is equal to or larger than 50 $\mu$m, but less than 200 $\mu$m.

9. The method of claim 7, wherein the overflow grooves are formed around the silicon substrate.

10. The method of claim 7, wherein the ink slots are manufactured by either anisotropic or isotropic etching.

11. The method of claim 7, wherein the ink slots are manufactured by a laser.

12. The method of claim 7, wherein the ink slots are manufactured by sandblasting.

13. The method of claim 7, wherein the ink slots are connected to each other.

14. The method of claim 7, wherein each of the ink slots is individual.

15. An ink-jet printhead chip comprising:

a silicon substrate having a first surface and a second surface, wherein a plurality of grooves are formed on the first surface in the silicon substrate;

a plurality of ink slots formed on bottom portions of the grooves of the silicon substrate, wherein the ink slots extend to the second surface of the substrate, a width of the grooves is larger than a width of the ink slots, and a depth of the ink slots is equal to or larger than 50 $\mu$m, but less than 200 $\mu$m; and a plurality of firing chambers formed on and adjacent to the second surface, wherein each of the firing chambers is respectively connected to each of the ink slots.

16. The ink-jet printhead chip of claim 15, wherein the ink slots are connected to each other.

17. The ink-jet printhead chip of claim 15, wherein each of the ink slots is individual.

18. A method for fabricating an ink-jet printhead chip comprising the steps of:

providing a silicon substrate having a first surface and a second surface;

etching the first surface from a first direction directed to the first surface to form at least one groove in the silicon substrate;

after the grooves being formed in the substrate, etching the first surface on a bottom portion of the groove from the first direction to form a plurality of ink slots in the silicon substrate, wherein the ink slots extend to the second surface of the substrate and connect the groove and the second surface of the substrate, a width of the grooves is larger than a width of the ink slots, and a depth of the ink slots is equal to or larger than 50 $\mu$m, but less than 200 $\mu$m; and forming a plurality of firing chambers on the second surface, wherein each of the firing chambers is respectively connected to each of the ink slots.

19. A method for fabricating an ink-jet chip, comprising the steps of:

providing a silicon substrate having a first surface and a second surface;

etching the first surface to form at least one groove in the silicon substrate, wherein the groove does not extend to the second surface;

forming a plurality of ink slots in the silicon substrate, wherein the ink slots connect the groove and the second surface, and a depth of the ink slot is about 70 $\mu$m; and forming a plurality of firing chambers on the second surface, wherein each of the firing chambers is respectively connected to each of the ink slots.

20. A method for fabricating an ink-jet chip, comprising the steps of:

providing a silicon substrate having a first surface and a second surface;

etching the first surface to form a plurality of grooves in the silicon substrate;

forming a plurality of ink slots in the silicon substrate in each of the grooves, wherein the ink slots connect the grooves and the second surface, and a depth of the ink slot is about 70 $\mu$m;

forming a plurality of overflow grooves on the first surface; and forming a plurality of firing chambers on the second surface, wherein each of the firing chambers is respectively connected to each of the ink slots.

21. A method of fabricating an ink-jet chip comprising the steps of:

providing a silicon substrate having a first surface and a second surface;

etching the first surface to form at least one groove having a width in the silicon substrate;

etching the first substrate to form a plurality of ink slots in the silicon substrate, wherein the ink slots connect the groove, and a width of the grooves is larger than a width of the ink slots, and wherein a depth of the ink slots is about 70 $\mu$m; and forming a plurality of firing chambers on the second surface, wherein each of the firing chambers is respectively connected to each of the ink slots.

* * * * *